United States Patent [19]

Gilvar

[11] 4,037,450

[45] July 26, 1977

[54] APPARATUS FOR SUPPORTING BEARING CHOCKS IN A ROLLING MILL

[75] Inventor: Martin Gilvar, Oakham, Mass.

[73] Assignee: Morgan Construction Company, Worcester, Mass.

[21] Appl. No.: 732,392

[22] Filed: Oct. 14, 1976

Related U.S. Application Data

[63] Continuation of Ser. No. 632,685, Nov. 17, 1975, abandoned, which is a continuation-in-part of Ser. No. 562,636, March 27, 1975, abandoned.

[51] Int. Cl.[2] ..... B21B 31/02; B21B 31/24

[52] U.S. Cl. ..... 72/237; 72/248

[58] Field of Search ..... 72/237, 238, 247, 248; 248/358 R

[56] References Cited

U.S. PATENT DOCUMENTS

| | | | |
|---|---|---|---|
| 2,729,123 | 1/1956 | Breedon et al. | 72/244 X |
| 3,866,073 | 2/1975 | Gjaja | 248/358 R X |

*Primary Examiner*—Milton S. Mehr

*Attorney, Agent, or Firm*—Thompson, Birch, Gauthier & Samuels

[57] ABSTRACT

An apparatus is disclosed for use in a rolling mill to support the bearing chocks of a work roll in a roll housing. The apparatus includes specially designed components interposed between the bearing chocks and the restraining devices employed to oppose the axial and transverse forces developed during a rolling operation. The aforesaid components offer minimum resistance to movement of the bearing chocks through minute distances in the direction of rolling. The apparatus of the present invention makes it possible to measure tension in the product being rolled by employing sensing devices acting on the bearing chocks.

4 Claims, 6 Drawing Figures

APPARATUS FOR SUPPORTING BEARING CHOCKS IN A ROLLING MILL

CROSS REFERENCE TO RELATED APPLICATION

This application is a continuation of U.S. application Ser. No. 632,685, filed Nov. 17, 1975, now abandoned which is a continuation-in-part of U.S. application Ser. No. 562,636, filed Mar. 27, 1975, now abandoned.

BACKGROUND OF THE INVENTION

This invention relates generally to rolling mills, and in particular to an improved means for supporting the bearing chocks of a work roll in a roll housing.

During a rolling operation, particularly where grooved work rolls are employed to roll shaped products such as rounds, angles or the like, the rolls are subjected to both transverse and axial forces. The transverse forces (commonly referred to as "separating forces") tend to urge the rolls apart, whereas the axial forces tend to shift the rolls axially. If product tolerances are to be maintained, the bearing chocks must be supported or restrained in a manner which effectively opposes both such transverse and axial forces.

The traditional means which have heretofore been employed to restrain bearing chocks are, however, somewhat inconsistent with certain requirements of modern rolling mill design and operation. For example, recent developments in systems for measuring product tension in a continuous multi-stand mill require that at least one of the work rolls of the cooperating roll pair, and its respective bearing chocks be capable of substantially free movement through minute distances on the order of several thousandths of an inch in the direction of rolling. In such systems, sensing devices act on the bearing chocks of the said one roll to monitor product tension. However, conventional restraining means impose a variable frictional load on the bearing chocks in the direction of rolling and this frictional load can be high enough to compromise the sensitivity and accuracy of the aforesaid sensing devices.

SUMMARY OF THE INVENTION

A primary object of the present invention is to overcome the above-stated disadvantage by interposing specially designed components between the bearing chocks of a work roll and the restraining means associated therewith. These specially designed components permit the bearing chocks to move relatively freely through minute distances in the direction of rolling, without compromising the ability of the restraining means to effectively oppose both the transverse and axial forces to which the roll is being subjected to during a rolling operation.

The aforesaid specially designed components include a rocker assembly having cooperating relatively slidable spherical surfaces interposed between the bearing chocks and the restraining means for opposing transverse or roll separating forces, and laminated bearing pads interposed between the bearing chocks and the clamping means employed to oppose the forces tending to shift the work rolls axially.

The bearing pads have laminated sections which are made up of alternate thin layers of metal and a suitable elastomer, with the orientation of the pads being such that these layers lie in planes which are parallel to the direction of rolling and thus perpendicular to the axes of the bearing chocks. These bearing pads are characterized by a high modulus of elasticity in compression, and a low modulus of elasticity in shear, i.e., in a direction parallel to the layers of the laminated section. By way of example, and for the rolling mill applications herein under consideration, such laminated bearing pads might typically have a modulus of elasticity in compression of 150,000 to 200,000 p.s.i., and a modulus of elasticity in shear of 60 to 80 p.s.i. (expressed as G = shear stress divided by unit shear strain, where unit shear strain is the total lateral shear strain divided by the total height of the member perpendicular to the shear load) which may be expressed alternatively as a lateral spring rate of approximately 3 lbs. per 0.001 inch. These laminated bearing pads thus have the ability to cooperate effectively with the clamping means employed to restrain bearing chocks against movement in an axial direction, even when the bearing chocks are being subjected to very high thrust forces on the order of 50,000 pounds, while at the same time allowing the bearing chocks to move with minimum resistance in the direction of rolling.

Through the combined use of the aforesaid rocker assemblies and laminated bearing pads, the bearing chocks are effectively restrained in a manner which permits them to move minutely in the direction of rolling without attendant frictional resistance sufficient to impair the accuracy of sensing devices acting on the bearing chocks.

BRIEF DESCRIPTION OF THE DRAWINGS

An embodiment of the invention will now be described by way of example only with reference to the accompanying drawings, wherein.

DESCRIPTION OF PREFERRED EMBODIMENT

Figure 1:
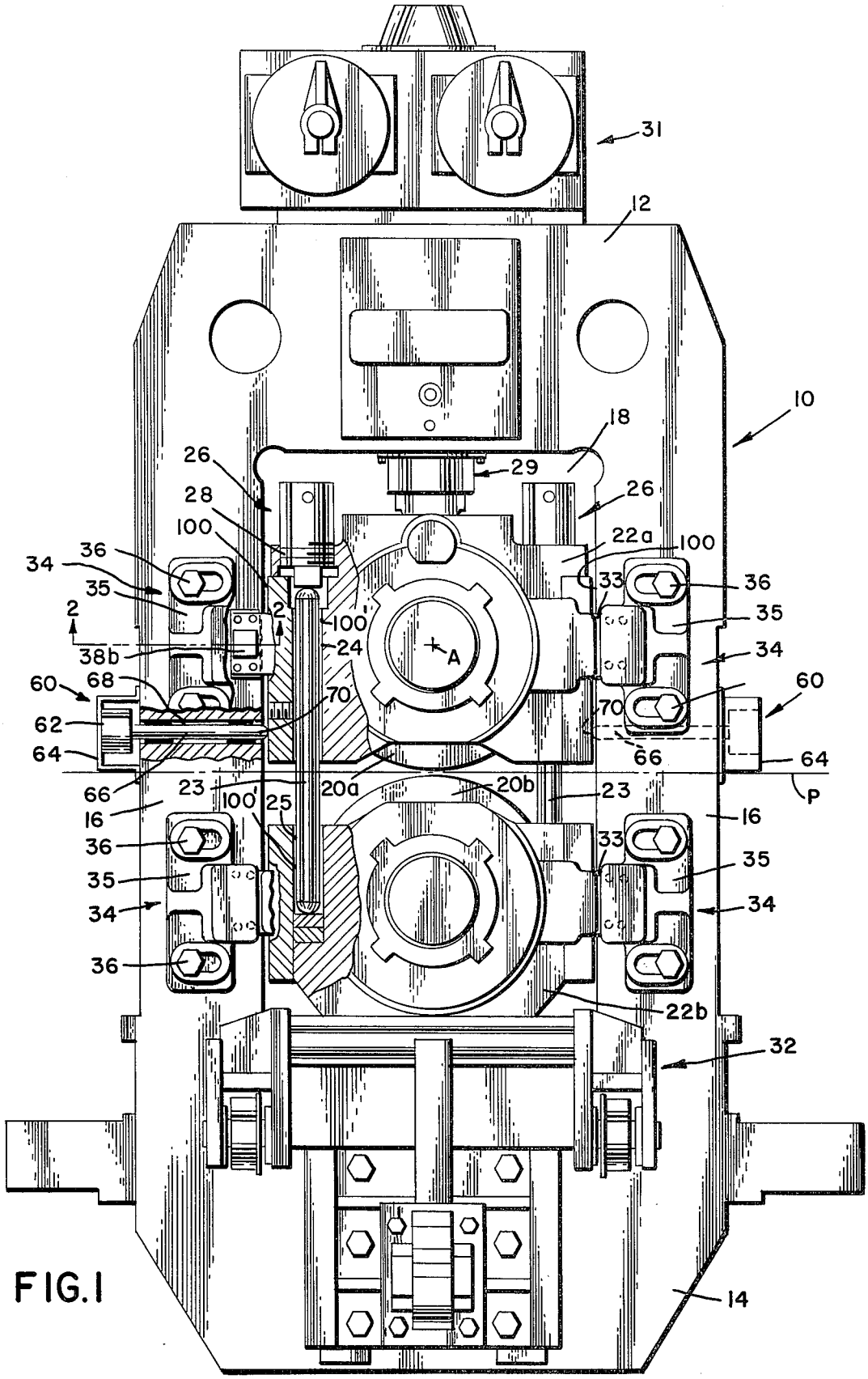
FIG. 1 is a view in side elevation of a horizontal roll housing in a rolling mill, with portions broken away.
Figure 3:
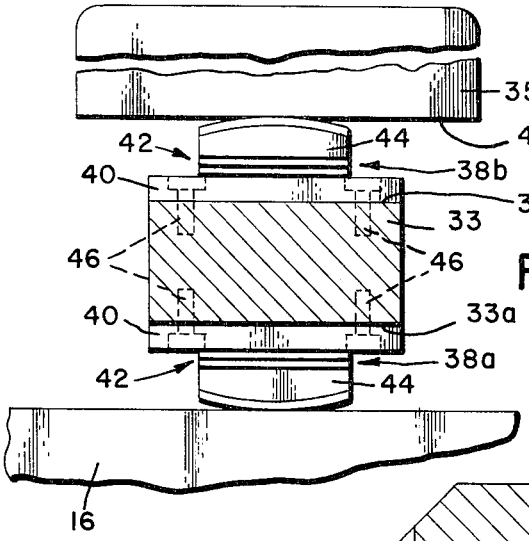
FIG. 3 is a sectional view taken along line 3—3 of FIG. 2.
Figure 2:
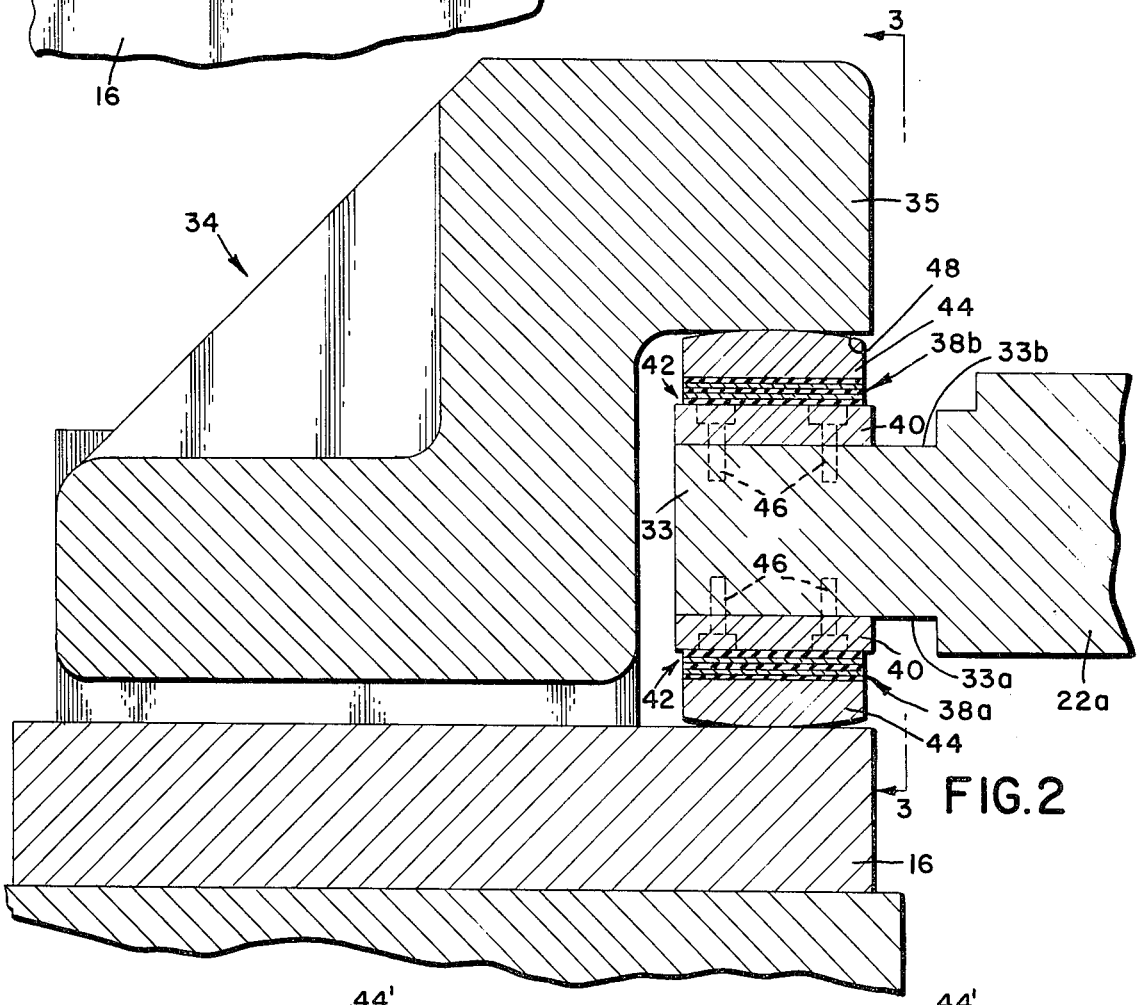
FIG. 2 is a sectinal view on an enlarged scale taken along lines 2—2 of FIG. 1.

Referring now to the drawings, there is shown in FIG. 1 the work side of a typical horizontal roll housing 10 in a rolling mill. The housing has top and base sections 12 and 14 which together with vertically extending housing posts 16, define the housing window 18. Upper and lower horizonal work rolls 20*a,* 20*b* are journalled for rotation between upper and lower bearing chocks 22*a,* 22*b.* Although not shown, it will be understood that each roll 20*a,* 20*b* is respectively journalled between a pair of bearing chocks 22*a,* 22*b.* Where shaped products are being rolled, the work rolls are appropriately grooved, with mating grooves cooperating to define roll passes. Pins 23 extend through enlarged bores 24 in the upper bearing chocks 22*a* and into enlarged bores 25 in the lower bearing chocks 22*b.* Hydraulic piston-cylinder units 26 are threaded as at 28 into the upper chocks. The units 26 act through the pins 23 to hold the upper bearing chocks 22*a* up against rocker assemblies 29 which are interposed between the upper bearing chocks 22*a* and the screws 30 (see FIG. 6) of the housing screw down mechanisms 31. The upper and lower rolls 20*a,* 20*b* and their respective bearing chocks 22*a,* 22*b* and intermediate pins 23 form an interchangeable unit commonly referred to as a "roll package" which is carried into and out of the roll housing 10 through the window 18 by means of an underlying carriage assembly 32. The construction and operation of the carriage assembly 32 is more fully described in U.S. Pat. No. 3,675,456 assigned to the same assignee as that of the present invention.

As previously mentioned, systems are now being developed to monitor product tension by employing sensing devices associated with the bearing chocks of at least one roll of a given roll pair. In the following discussion, one such arrangement will be described in connection with the bearing chocks 22*a* of the upper work roll 20*a.* It will be understood, however, that the same basic arrangement could be employed if desired with the bearing chocks 22*b* of the lower roll 20*b.*

With reference additionally to the remaining FIGS. 2–6, it will be seen that the upper bearing chocks 22*a* are each provided with laterally extending lugs or "ears" 33. The ears 33 have oppositely facing inner and outer planar surfaces 33*a,* 33*b* which are perpendicular to the axis "A" of the bearing chocks. The axis A is of course perpendicular to the mill pass line "P", which is the direction of rolling through the mill. Clamping means generally indicated at 34 are associated with the housing posts 16 to act on ears 33 for the purpose of restraining the bearing chocks against axial movement.

In the embodiment being described herein for purposes of illustration, each clamping means 34 comprises a clamp 35 attached to one of the housing posts 16 by any convenient means, for example bolts 36. Specially designed bearing pads 38*a,* 38*b* are interposed between each ear 33, the clamp 35 and the housing post 16. The bearing pads each preferably include a mounting plate 40, a laminated section 42 made up of alternate very thin planar layers of metal 42*a* and a suitable elastomer 42*b* (see FIGS. 4 and 5), and a nose 44 having a curved contact surface 44' which can either be spherical as shown in the drawings, or crowned in the appropriate direction. The mounting plate 40 of bearing pad 38*a* is attached as by screws 46 to the planar surface 33*a* of ear 33, and the mounting plate 40 of the opposite bearing pad 38*b* is likewise attached as by screws 46 to the opposite face 33*b* of ear 33. The spherical contact surfaces 44' of the noses 44 of the bearing pads 38*a,* 38*b* bear respectively against the housing post 16 and the underside 48 of the nose on clamp 35.

The laminated sections 42 of the bearing pads may be comprised of a commercially available material sold under the trade name "LAMIFLEX" by the Marlin-Rockwell Corporation of Jamestown, N.Y., U.S.A. The orientation of the bearing pads is such that the layers (42*a,* 42*b*) making up the laminated section 42 lie in planes which are perpendicular to the axis A of the bearing chocks. As indicated previously, the bearing pads 38*a,* 38*b* are characterized by a high modulus of elasticity in compression and a low modulus of elasticity in shear.

Figure 4:
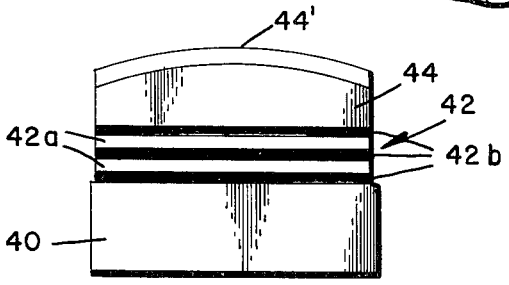
FIG. 4 is a schematic illustration of a typical bearing pad in accordance with the present invention with the thickness of the layers making up the laminated section exaggerated for purposes of illustration.
Figure 5:
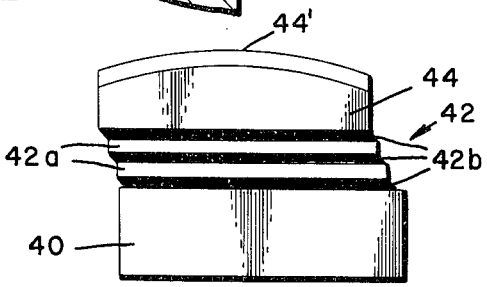
FIG. 5 is a view similar to FIG. 4 but with lateral distortion (again exaggerated for purpose of illustration) of the laminated section of the bearing pad; and, FIG. 6 is an enlarged partial view, in section, showing details of the rocker assembly.

The operating principle of the laminated sections 42 is based on the elasticity of the thin elastomer layers 42*b* between the metal layers 42*a.* As shown by a comparison of FIGS. 4 and 5, when a lateral force is applied to the bearing chocks in the plane of the layers, for example as the result of tension in the product being rolled, each of the elastomer layers will distort or stretch to accommodate lateral displacement of the ears 33 and attached mounting plates 40 in relation to the noses 44. The amount of compressive load applied perpendicular to the layers has no appreciable effect on the amount of force required to produce the aforesaid lateral movement. However, axial compression of the bearing pad under load is negligible because the elastomer layers 42*b* are relatively incompressible. It will thus be seen that by employing the specially designed bearing pads 38*a,* 38*b* between the chock ears 33 and the cooperating clamping means 34 and housing posts 16, the bearing chocks are effectively prevented from moving axially, and this result is achieved without impairing the abillity of the chocks to move laterally and substantially freely through minute distances in response to product tension in the direction of rolling. Sensing devices generally indicated at 60 are employed to sense forces exerted on the upper roll chocks 22*a* as a result of tension developed in the product being rolled. Each sensing device comprises a transducer 62 mounted under a cover 64 attached to the housing posts 16. Detection rods 66 extend through openings 68 in the housing posts 16 with their ends in contact with the bearing chocks at opposite sides thereof as at 70. The transducers are initially calibrated to a zero reading prior to the commencement of a rolling operation. Thereafter, as rolling is initiated, any tension developed in the stock will exert a force on the bearing chocks in the direction of rolling. This force will be sensed by the transducers 62, which in turn will emit signals capable of being employed in a mill control scheme.

As previously mentioned, in addition to restraining the bearing chocks against axial movement, it is also necessary to oppose the transverse roll separating forces. This is accomplished in part by the screws 30 of the housing screw down mechanism 31 acting on the upper bearing chocks 22*a,* and by appropriate lower supports (not shown) for the lower bearing chocks 22*a.* In order to accommodate relatively free movement of the upper bearing chocks 22*a* through minute distances in the direction of rolling, a specially designed rocker assembly 29 is interposed between each screw 30 of the mill screw down and the underlying upper chock 22*b.*

Figure 6:
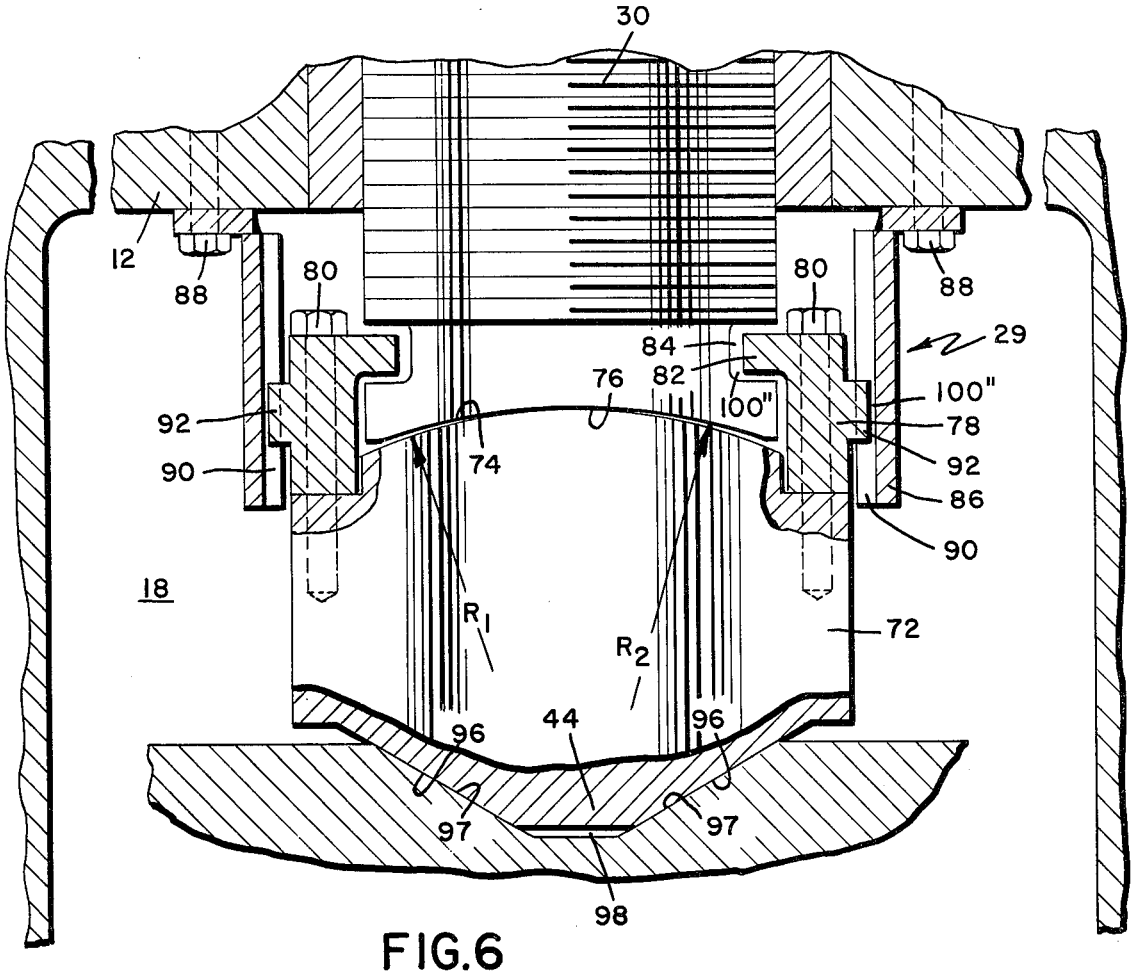

As is best shown in FIG. 6, each rocker assembly 29 includes a head 72 with a spherical upper surface 74 adapted to slidably contact a spherical surface or seat 76 on the end of the screw 30. A split retaining ring 78 is secured to the head 72 by means of bolts 80. The retaining ring 78 has an inner flange 82 which is received in a groove 84 in the screw 30. The split retaining ring 78 serves as the means for removably attaching the head 72 to the screw 30, and for retaining these two components in a cooperative relationship when the screw is retracted.

A collar 86 surrounds the split retaining ring 78. The collar is removably secured to the top housing section 12 as at 88, and has inner vertical grooves 90 into which protrude ears 92 on the head 72. The ears 92 cooperate with the grooves 90 to prevent rotation of the head 72 during operation of the screw 30.

The lower end of head 72 has a nose 94 formed in part by inclined faces 96 adapted to engage the mating inclined faces 97 of a notch 98 in the top surface of the upper bearing chock 22*a.* Preferably, spherical surface 74 has a radius $R_1$ which is slightly shorter than the radius $R_2$ of the seat 76. Both radii $R_1$ and $R_2$ extend generally from the axis A of the bearing chocks. The spherical interface between each head 72 and its associated screw 30 further facilitates movement of the upper bearing chocks 22*a* in the direction of rolling by allowing the bearing chocks and the heads in contact therewith to rock relative to the screws 30.

The use of mating inclined surfaces 96, 97 between the heads 72 and the bearing chocks 22*a* represents a departure from conventional constructions where a flat interface is provided between similar components in a plane parallel to both the bearing axis A and the mill pass line P. The disadvantage of the conventional construction is that it leads to the possibility that the chocks may translate in the direction of rolling under some conditions of product tension and rolling forces, while being able to rock relative to the screws 30 under other conditions of tension and rolling forces. This potential inconsistency will in turn lead to unpredictable outputs from the sensing devices 60. The advantage of the disclosed construction is that it limits relative movement between the screws 30 and bearing chocks 22*a* to that permitted by the sliding interface between mating spherical surfaces 74, 76.

Movement of the bearing chocks 22*a* in the direction of rolling is minute, typically on the order of several thousandths of an inch. The normal working clearances present between the bearing chocks and the housing windows as at 100, between the pins 23 and their respective bores 24, 25 as at 100', and between the split retaining ring 78 and the screws 30 and surrounding collars 86 as at 100'' are sufficient to accommodate any such movement.

It will thus be seen that broadly speaking the present invention is concerned with facilitating movement of the bearing chocks of a work roll through minute distances in the direction of rolling to thereby accommodate more accurate measurement of product tension by means of sensing devices acting on the bearing chocks. This is accomplished in the preferred embodiment herein disclosed by providing specially designed components between the bearing chocks and the restraining means acting to oppose both axial and transverse forces developed during rolling. In the axial direction, special laminated bearing pads 38*a,* 38*b* are interposed between the chock ears 33 and clamps 35 and housing posts 16 associated therewith. In the transverse direction, specially designed rocker assemblies 29 with cooperating spherical surfaces 74, 76 are interposed between the screws 30 of the screw down mechanism 31 and the bearing chocks 22*a.* The combination of the rocker assemblies 29 and the bearing pads 38*a,* 38*b* allows the bearing chocks 22*a* to move minutely in the direction of rolling with minimum frictional resistance, thereby greatly improving the accuracy of the sensing devices 60.

In light of the foregoing, it will be understood by those skilled in the art that the same concepts can be applied to the lower bearing chocks 22*b* of a horizontal roll stand, as well as to the chocks of any other roll stand where for example the rolls are vertical or inclined at an angle.

Similarly, although a fixed clamping arrangement 34, 16 has been employed herein for illustrative purposes, it will be understood that the invention could be incorporated into an adjustable clamping arrangement which provides axial position adjustment of the bearing chocks.

It is my intention to cover all changes and modifications of the invention herein chosen for purposes of disclosure which do not depart from the spirit and scope of the invention.

I claim:

1. In a rolling mill, the combination comprising: a housing; a work roll journalled for rotation between bearing chocks contained in said housing; first restraining means acting on said chocks to oppose forces exerted axially on said roll during mill operation; second restraining means acting on said chocks to oppose roll separating forces exerted transversally on said roll during mill operation, said housing and said first and second restraining means being suitably dimensioned to accommodate movement of said chocks in the direction of rolling during mill operation; bearing pads positioned between opposed surfaces of said bearing chocks and said first restraining means, each of said bearing pads having integrally joined alternating layers of metal and an elastomer lying in planes perpendicular to the chock axes, the said layers being subjected both to compression between said opposed surfaces and to shear tending to distort said elastomer layers to accommodate chock movement in the direction of rolling as tension is developed in the product being rolled.

2. The apparatus as claimed in claim 1 wherein said laminated sections are characterized by a high modulus of elasticity in compression in a direction perpendicular to said layers, and a low lateral spring rate in a direction parallel to said layers.

3. The apparatus in claim 2 wherein said high modulus of elasticity in compression is in the range of 150,000 to 200,000 p.s.i.

4. The apparatus as claimed in claim 3 wherein said lateral spring rate is approximately 3 lbs. per 0.001 inch.

* * * * *